United States Patent [19]

McBride

[11] 4,409,866

[45] Oct. 18, 1983

[54] TOOL HANDLE WITH CONTOURED THROUGH PASSAGEWAY AND SPRING BIASED TRIGGER

[76] Inventor: Joan McBride, 559 Chestnut Street, Westwood, N.J. 07675

[21] Appl. No.: 334,577

[22] Filed: Dec. 28, 1981

[51] Int. Cl.[3] ..... B25G 1/04

[52] U.S. Cl. ..... 81/177 A; 145/64

[58] Field of Search ..... 145/61 L, 64; 81/177 A, 81/438

[56] References Cited

U.S. PATENT DOCUMENTS

| | | | |
|---|---|---|---|
| 1,269,413 | 6/1918 | Finnigan | 145/64 |
| 1,578,065 | 3/1926 | Bemus et al. | 81/177 A X |
| 2,592,978 | 4/1952 | Trimboli | 145/64 |
| 2,652,736 | 9/1953 | Kiene | 81/177 A |
| 2,672,066 | 3/1954 | Sandrock et al. | 145/61 L X |
| 3,255,792 | 6/1966 | Beck | 81/438 X |
| 3,508,455 | 4/1970 | Miller | 145/61 L |

*Primary Examiner*—James G. Smith

*Attorney, Agent, or Firm*—Ralph R. Roberts

[57] ABSTRACT

This invention includes and is directed toward and to a tool handle exemplified in two embodiments. A variety of tool blades can safely be inserted in one end of the tool handle allowing length and leverage heretofore impossible. This feature allows a person to carry the wrench in a closed tool box since the parts disassemble for storage. A ratchet can be inserted in the opposite end of said handle to provide the user with much greater torque to assist in many difficult jobs. The handle has a through passageway substantially along its longitudinal axis. In the passageway there is formed at least one flat surface with the passageway sized to snugly retain the shank of a tool. The tool handle includes a body provided with a trigger having two legs, one of which has an aperture which is moved in way of the passageway to allow the shank of the tool to be moved therein and therethrough. The trigger is biased outwardly to bring a portion of the trigger in way of one of a series of slots or detents formed in the tool shank and locking said shank in the selected position. The trigger is limited in its outward movement and against loss by a retaining pin secured in the handle and arranged to engage the other leg of the trigger and limit the outer travel of the trigger.

7 Claims, 17 Drawing Figures

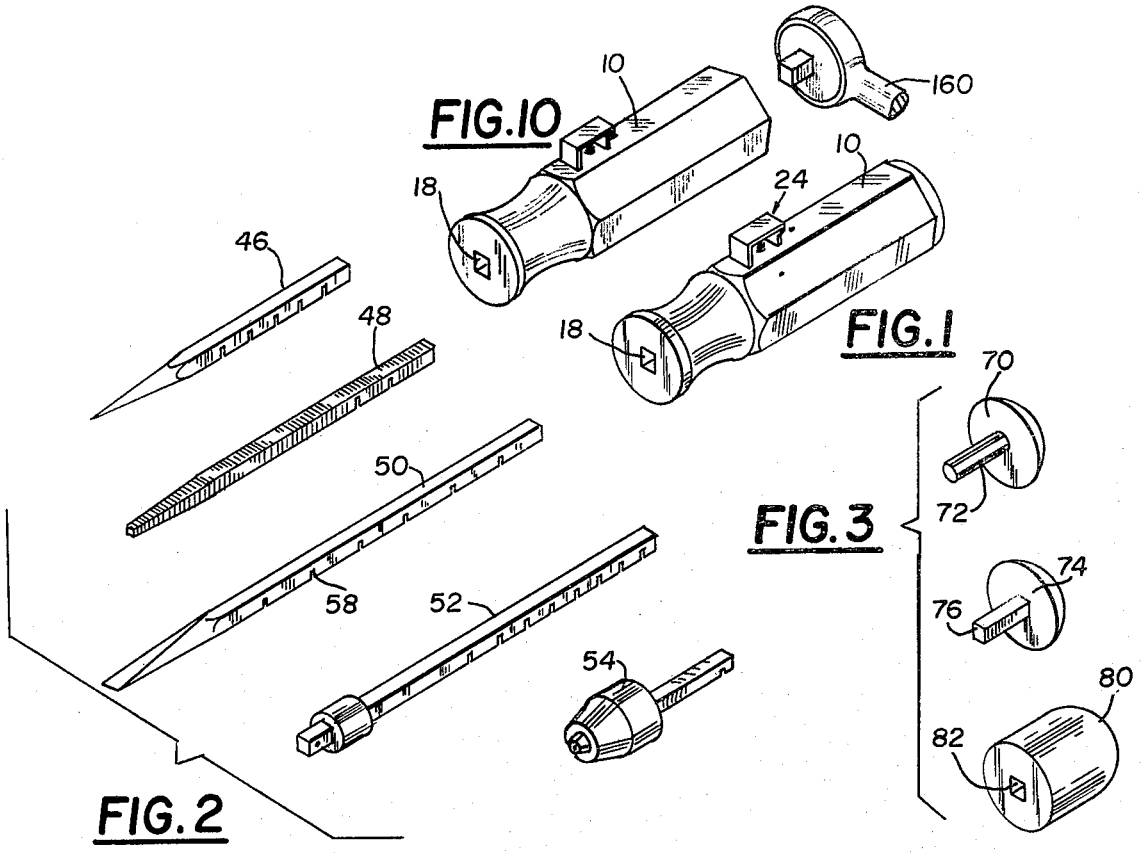
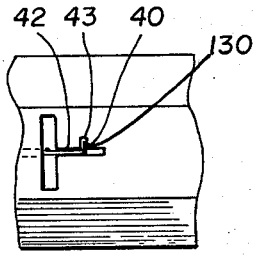
FIG.8
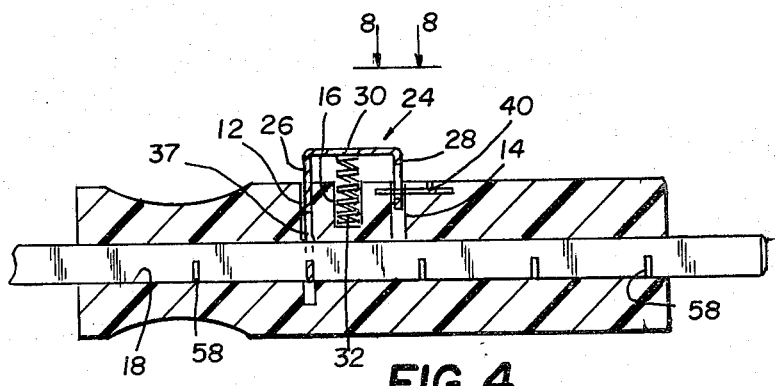
FIG. 4
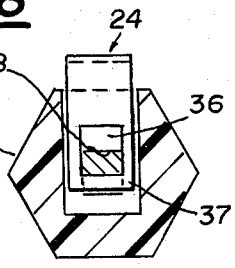
FIG.7
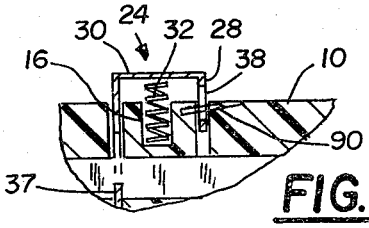
FIG.5
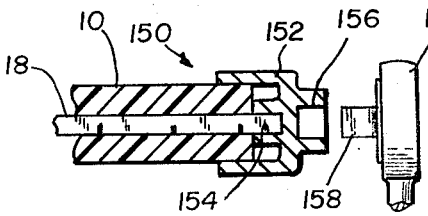
FIG.9
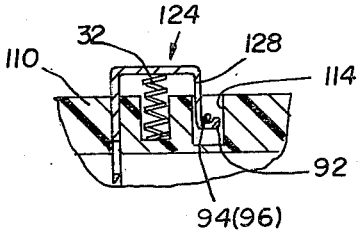
FIG. 6

TOOL HANDLE WITH CONTOURED THROUGH PASSAGEWAY AND SPRING BIASED TRIGGER

BACKGROUND OF THE INVENTION

1. Field of the Invention

With reference to the classification of art as established in and by the United States Patent Office the present invention is believed to be found in the general class entitled, "Chucks or Sockets" (Class 279) and in the subclass therein entitled, "Side detent-spring" (Subclass 79) and also the general class entitled, "Woodworking Tools" (Class 145) and the subclass entitled, "Handle-hollow-retractable tool" (Subclass 64).

2. Description of the Prior Art

A careful pre-Ex search was made for hand tools with removable shank members mountable in handles with through passageways. Although many handles with chuck portions at their front end were found and are known the use of a handle with a through passageway with at least one flat surface is much less. Tool shanks with notches with the shank portions engaged by pins and the like are known but the use of a spring-actuated trigger which is selectively movable while being retained against loss or undue outer movement by a retaining pin is believed novel. Also believed novel is the added feature of the shank end of the blade being shaped to accommodate a rachet socket.

Found in the pre-Ex search are U.S. Pat. Nos. 1,269,413; 2,592,978; 2,674,286; 3,255,792 and 4,102,375. Three of these U.S. patents are particularly noted. U.S. Pat. No. 1,269,413 to Finnigan as issued June 11, 1918 shows a screw driver which a square shank removable screw driver bit. The notches in said bit are engaged by a latch key which is spring biased but there is no teaching of a trigger retaining means as in applicant's device. U.S. Pat. No. 2,592,978 to Trimboli as issued Apr. 15, 1952 also shows a square shanked tool member with circular grooves. An end cap with a square aperture is rotatable to a ninety degree position whereby and whereat the grooves are entered and locked to a position the shank in the desired position. The ball detent is a position assist and not a trigger retaining device. U.S. Pat. No. 2,674,286 to Carson as issued Apr. 6, 1954 depicts a square shank tool and a locking member which is spring actuated into a holding position. The spring urges the blocking member outwardly but there is no retaining means provided for the trigger as in applicant's device.

SUMMARY OF THE INVENTION

This invention may be summarized, at least in part, with reference to its objects. It is an object of this invention to provide, and it does provide, a tool handle with a bias actuated trigger means and having one leg movable in a passageway therethrough. An aperture in the leg of the trigger is sized to freely pass a formed shank of a tool and when the tool is positioned at the desired insertion the trigger is released so that a leg blade portion of the trigger slides into and engages a like notch in the shank.

It is a further object of this invention to provide, and it does provide, a tool handle with a spring biased trigger mounted at midlength thereof. This trigger has two leg portions, one of which is slidable in a transverse slot extending through the axis of the passageway in the handle. This leg has an aperture therethrough which is sized to freely pass a shank of a tool. This aperture is adapted to coincide with a through passageway formed in the handle. A rear leg of the spring is also movable in a slot in the handle and this leg has an elongated aperture therein. Through this aperture is passed a retaining pin which limits the outward movement of the trigger. Said trigger is spring-biased with the leg which has the shank aperture moving into one of the several like formed slots in the shank of the tool to retain this shank at the selected position.

It is a further object to provide, and it does provide, a tool handle in which a tool shank which has a determined length has notches in its midportion by which the tool may be lengthened or shortened for convenience of use by the operator and for a particular job or application.

It is a still further object of this invention to provide, and it does provide, a tool handle in which the handle, the trigger, the spring or bias means and/or the trigger retaining pin are easily and inexpensively replaced.

It is a further object of this invention to provide, and it does provide, a tool handle for wrenches in which the extending shank is configured with a constant cross section and with notch means therein for engaging a mounted handle. Members are shown for safely extending the handle without possible disengagement during use as occurs when loose pipe sections are used.

In brief, the handle for driving or turning any of the insertable shank tools is preferably of molded plastic with a through passageway. Preferably this passageway is square but as long as there is at least one flat driving surface therethrough the engaged and retained shank may be manipulated. Removably mounted and retained in this passageway is a shank of a tool which may be a socket driver, a file, an awl, a threaded tap, a twist drill, a screwdriver blade or any of the other tools that may be manipulated by and with a handle. The shank of each tool has a series of slots of like configuration and depth into which a leg portion of a trigger is movable to provide a stop and retention.

The tool shank may also include extension shank portions that can and are made in sections much like extensions for ratchet-type tools. The shank that is received and retained by the handle is a slide fit in the passageway and has notches that provide the desired adjustment. Such arrangements are particularly useful when inserting and/or removing a screw or bolt in a deep utility box.

This handle has a spring-biased trigger of sheet metal and has a U-shape. One leg (preferably the forward leg) of the trigger is movable in a transverse slot extending through the passageway in and through the handle. This leg has an aperture therethrough which is sized and adapted for free passage of the shank of a tool when slidable in and aligned with said passageway. This trigger is moved outwardly by a spring bias or a resilient member which may be used. This bias moves the trigger and leg portion outwardly so the leg portion enters into the formed notch in a shank of a tool. This aperture in the leg and the passageway is aligned to insert and withdraw the shank of the tool.

A rear leaf portion of the spring-biased trigger is also movable in and is slidably guided by a slot formed in this handle. In two embodiments this rear leaf has an elongated aperture therethrough. A small retaining pin is mountable in a tight hole in the handle and is disposed to pass through this elongated small aperture and limit or inhibit the outward movement of the trigger so as to prevent loss or accidental dislodgement of the trigger from the handle. The rear leg is also shown with lip portion at substantially right angles to the normal plane of the leg. A pin or transverse to the longitudinal axis of the handle is mountable in a like sized tight hole and this pin provides an inhibiting stop to limit the outward movement of the trigger member. There is no elongated aperture in the rear leg when a lip portion is used.

Each shank is of a like cross sectional size and the notches therein are spaced to suit the use of the particular tool. The tool shank may be short or long with a short tool being stored within the handle until time for use or to protect the user by withdrawing the sharp end of the tool into the handle. The notches in the tool shanks are substantially transverse to the axis of the shank and are more-or-less similar to saw cuts of like size and depth. The passageway in the handle may be closed at the rear end by a removable plug or the protruding end of the shank may have a removable plug or may be protected by an enlarged bumper.

The tool handle is also used with wrenches having handle portions of a constant size. In these handle portions notches are provided at selected intervals such as one-half inch. These notches are formed in and at the edge portions so as to not weaken the handle. The adjustable tool handle is a slide fit on and over the wrench handle to extend said wrench up to two thirds its length and strengthens said contoured handle portion and also provides a comfort grip. Since the extended wrench and handle may not provide the desired extent of lever arm, the handle may be lengthened by using handle extension portions. The concept of this tool handle is shown and described in detail in conjunction with the drawings.

The tool handle and mating shank of this invention provides many advantages over the known and prior art. The tool shank can and is moved in and out of the handle to provide a lengthened or shortened tool length for convenience in use for the job. For carrying, the tool shank is often moved into the handle so the tool is easily and safely transported. The handle has a through passageway which permits the mounting or insertion of a resilient bumper in the rear. This bumper protects the extending shank against pounding as an overlaid and/or prevents damage from an extending tool shank end. The one handle for many tools saves space and permits storage of many tools in a small case. One or more of the several parts are easily replaced if damaged. With a square or hex shank the rearwardly extending shank may be engaged by a ratchet wrench by which the tool shank may be turned or assisted. When the tool shank has a pointed end such as an awl the point may be brought within the passageway for safety in transport. A forward end of said tool shank may have any desired configuration usable with a turning handle and where convenience and/or length is a consideration.

The embodiments hereinafter shown and described have tool handles that provide two distinct uses. A first use is for turning a shank and the other use is for a handle to increase the lever arm without a turning of the handle. A ratchet wrench is shown with both applications. Where and when the tool handle is used to turn an inserted shank a ratchet wrench may be used to increase the turning moment and therewith provide an assist to and for turning an inserted shank. The handle is shown with a reinforced passageway or an added socket-like member may be provided. The tool handle is also shown as adjustably positioned on wrenches such as a ratchet, pipe or adjustable open end. Extension members are selectively mountable in this handle to extend the length of the handle and to increase the lever arm.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen specific embodiments of a handle with a spring actuated retaining and release means in the form of a trigger leaf. This handle is shown in two configurations and is adapted for use with various tool shanks and wrenches and depicts a preferred means for biasing the trigger and preventing loss or disengagement. These specific embodiments have been chosen for the purpose of illustration and description as shown in the accompanying two sheets of drawings wherein:

BRIEF DESCRIPTION OF THE DRAWINGS

FIG. 1 represents an isometric view of a handle usable with the shanks shown in other figures;

FIG. 2 represents an isometric view of insertable shank tools representative of the many that may be used with and by the handle, each of the tool shanks shown with notches of like size and transverse to the longitudinal axis of the shank;

FIG. 3 represents an isometric view, partly diagrammatic, and showing end protecting members which may be used with the handle or may be used with and on the end of the shank;

FIG. 4 represents a sectional side view of the handle and tool shank and showing in particular the structure and shape of the trigger and one means for retention of the trigger;

FIG. 5 represents a sectional side view, partly fragmentary and diagrammatic and showing an alternate method of retaining the trigger of FIG. 4;

FIG. 6 represents a sectional side view, partly fragmentary and diagrammatic and showing yet another alternate method of retaining a trigger similar to that of FIG. 4;

FIG. 7 represents a transverse sectional view of the handle and front leg of the trigger, this view taken on the line 7—7 of FIG. 4 and looking in the direction of the arrows;

FIG. 8 represents a fragmentary plan view of the handle, this view taken on the line 8—8 of FIG. 4 and looking in the direction of the arrows;

FIG. 9 represents a partly fragmentary, sectional side view of the handle of FIG. 4 as used with a metal socket member adapted to engage and retain the extending end of a tool handle and with and by a ratched wrench rotate this tool handle;

FIG. 10 represents an isometric view very similar to FIG. 1 and showing the handle being rotated by and with a ratchet wrench;

In the following description and in the claims various details are identified by specific names for convenience. These names are intended to be generic in their application. Corresponding reference characters refer to like members throughout the several figures of the drawings.

DESCRIPTION OF THE HANDLE AND TOOL SHANK

Figure 11:
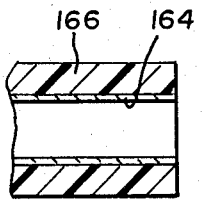
FIG. 11 represents a fragmentary sectional view of the tool handle of FIG. 4 but with the through passageway having a metal insert at its inner edge providing therewith added strength to the handle when a ratchet wrench is used to provide added torque.

Referring next to the drawing and the several views thereof, an handle 10 is shown in FIG. 1 and in detail in the sectional view of FIG. 4. For economy and utility's sake and ease of manufacture the handle is preferably of plastic for high impact resistancy. This handle 10 has a forward slot 12, a rear slot 14 and a circular recess 16. Said forward slot 12 extends transversely of and through a passageway 18 which is substantially central and longitudinally disposed through the handle. The handle 10, as seen in FIG. 4, is substantially full size and is preferably molded but this is not to preclude the making of this handle of wood, leather or metal.

A trigger member generally indicated as 24 has a forward leg portion 26 and a rear leg portion 28 which is connected by an integral bridge portion 30. A spring 32 is carried in a recess 16 and engages the bridge portion 30 so as to urge the trigger outwardly. The forward leg 26 is formed with an aperture generally identified as 36 and depicted as square (FIG. 7). Said aperture 36 is made in this forward leg at a position at the lower end of the leg. The aperture does not extend to the bottom but leaves an integral and supported blade stop portion 37 for a purpose to be hereinafter described.

The rear trigger leg 28 is formed with a small elongated aperture 38 that is vertically disposed and is used with a retaining pin 40 when and with said pin longitudinally disposed and mountable in a drilled hole in said handle. In FIGS. 4 and 8 said pin is identified as 40 and has a small right angle leg portion that is turned into a recess portion 42 to prevent dislodgement of the pin and engagement with a hand of a user. A straight pin 140 may be disposed at a slight angle as in FIG. 5. The elongated aperture 38 is adapted to receive and pass the longer leg of the pin 40 or 140 while slidable thereon. When the pin 40 is used, the longer leg passes through the elongated aperture 38 in the rear leg 28 and a short right angle portion is secured by rotating into the recess 42 in the handle.

TOOL SHANK MEMBERS AS IN FIG. 2

In FIG. 2 it is to be noted that the handle 10 may be used with any tool shank that is sized for the passageway 18 which has been formed and provided with said handle. As depicted, an awl 46; a file 48; a screw driver blade 50; a socket driver end 52 and a chuck member 54 are illustrative of the many shanks that may be used with this handle. Each shank is formed with a plurality of notches 58 which are of like width and depth. The spacing between notches is merely a matter of preference and convenience.

When adjustment is to be rather close the spacing between notches 58 may be as little as one-quarter of an inch, or where adjustment is to be greater, the spacing may be one-half to three-quarters of an inch apart. The notches are normally similar to saw slots and sized to be a slide fit in the forward leg portion 37 providing the blade stop of the trigger 24. The awl is shown with a sharp point but may be blunt and/or eliptical in configuration. The file is shown as square and tapered but may be round or any combination thereof. The screw driver blade is shown as flat but may also have a Phillips, a clutch head or other configuration, either as a separate member or with the other end formed with a desired shape. The socket drive is shown as square but may be hex or other selected shapes. The chuck for a drill or tap is illustrative of the many chucking means that may be used therewith. Other tool blades, now shown, may also be used.

REAR CLOSURE MEMBERS AS IN FIG. 3

In FIG. 3 are shown end stops or bumpers that may be used with and by the handle 10. A bumper stop 70 has an enlarged end that is spherically shaped for convenience. This bumper stop 70 is shown with a stem 72 that may be mounted in a drilled hole in the rear of a tool shank or may be mounted in the end of the handle. This stop is designed to protect the shank end of a tool or the handle when used to pound or hammer. A bumper stop 74 has a square shank 76 which is removably mounted in the rear end of the passageway 18. This bumper stop protects or closes the passageway and provides a spherical rear end for protection or pounding. Another bumper stop or protector is an overplug 80 having a square hole 82 therein with this hole adapted to snugly engage the rear end of a tool shank. It is contemplated that this overplug 80 be of molded plastic that is adapted for pounding by a hammer while protecting the end of the tool shank.

SECTIONAL VIEW AS IN FIG. 4

In FIG. 4 is depicted the handle 10 and the shank of a tool mounted in the passageway 18. Although the passageway 18 is conventionally square, this does not preclude other shapes and as long as there is one flat driving surface the shank may be mounted with a positive drive relationship of the handle to the tool shank. The trigger member 24 is preferably of tempered steel and after forming is mounted in the slots 12 and 14 and urged outwardly by spring 32. A pin 40 or 140 prevents unwanted outward movement of the trigger. As above noted, the trigger is spring-biased outwardly by spring 32 but a resilient plug-type member may also be employed. The aperture 36 is sized to freely pass the tool shank with the lower blade stop portion 37 entering into a notch 58 formed into a tool shank. When in a retaining position as in FIG. 4 the front leg portion 37 enters the sized notch and the biased trigger 24 locks the tool shank in a selected position. Adjustment in the position or removal of the tool is easily achieved by moving the trigger 24 against the spring bias until the tool shank is released and is slidable in the passageway 18.

The pin 40 enters and passes through the elongated aperture 38 in rear leg 28. A drilled hole is made in the handle and the pin 40 is mounted in said drilled hole and after insertion into a locking condition the pin 40 is turned so that the short leg portion enters and is retained in the recess 42.

ALTERNATE RETAINING PIN AS IN FIG. 5

In FIG. 5 the trigger 24 as above described is retained by a pin 140. This is a straight pin and is mounted in a drilled hole 90 formed in the handle 10. The pin 140 is passed through the aperture 38 in the rear leg 28 and retains the trigger from unwanted outer movement.

ALTERNATE RETAINING PIN AS IN FIG. 6

In FIG. 6 there is shown an alternate retaining of a trigger 124 in which the rear leg now identified as 128 has a short lower extending portion 92 bent at right angles to the leg 128. This rear leg has no elongated aperture formed therein. A handle 110 is formed with an enlarged slot 114 into which the rear leg 128 may enter and move. The trigger 124 is like trigger 24 at its front leg with an aperture 36 therethrough. The rear leg 128 is movable in slot 114 and a pin 94 is mounted and retained in a transversely drilled hole 96 in the handle 110. This pin 94 restrains the trigger 124 from unwanted excess outward travel as urged by the spring 32. This pin is disposed in sliding relationship with the outer surface of the rear leg 128. This pin as depicted in FIG. 6 also engages the right angled leg portion 128 of the trigger 110.

TRANSVERSE VIEW OF FIG. 7

The view of FIG. 7 is representative of the tool of this invention in that the handle 10 is usually of molded plastic and at the axis thereof the passageway 18 is longitudinally formed therethrough. The front leg of the trigger is formed with an aperture 36. Each tool shank is formed with a series of like notches 58 and into one of these notches the lower stop blade portion 37 of the front leg of the trigger is urged. This lower cross portion 37 of the front leg engages this notch and locks the tool shank in the selected position.

FACE VIEW OF FIG. 8

Referring next to FIG. 8 there is shown a fragmentary face view of the handle 10 with a recess 42 which is molded with a small right angled extension 43 adapted to receive and retain a short leg portion 130 of the pin 40.

EMBODIMENT OF FIG. 9

Referring next to FIG. 9, there is depicted the handle 10 of FIG. 4 but with the shank of a tool extending from the rear of the passageway 18 an amount sufficient for the mounting thereon of a formed metal socket member 150. This socket member has a formed outer collar member 152 and an internally shaped socket 154 adapted to releasably engage the protruding and extending end of a tool shank. The outer end of the socket member 150 is formed with a female socket 156 which is conventionally square or hex to receive and retain a drive post portion 158 of a ratchet wrench 160. This wrench is manipulated or otherwise disposed to turn the tool shank and handle either clockwise or counterclockwise. The collar member 152 may be circular or may be formed to be a sliding fit on the exterior of the contoured handle 10. Although the drive member is shown with a collar member 152 which provides additional support and alignment this is not to preclude the making of the drive member without the collar member 152.

EMBODIMENT OF FIG. 10

The handle of FIGS. 1 and 4 may have the through passageway formed with a square configuration. The ratchet wrench 160 is adapted for use with the handle 10 to provide additional torque.

EMBODIMENT OF FIG. 11

In FIG. 11 the handle of FIG. 4 is shown with a metal insert 164 which is secured in a handle 166 and provides a reinforcement of the passageway in and through the handle. The insert 164 is aligned with the through passageway and provides means for repeated use of a ratchet wrench 160 as in FIG. 10.

Figure 12:
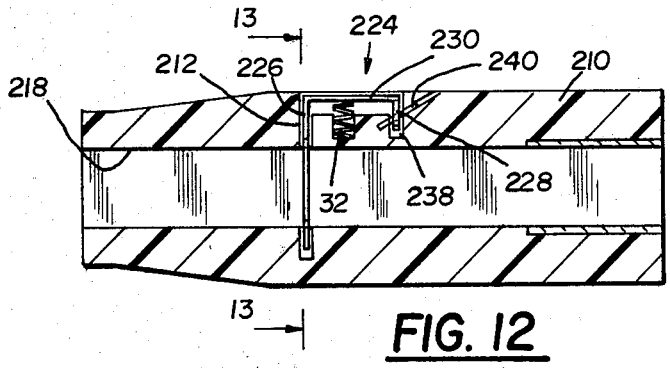
FIG. 12 represents a sectional side view very similar to that of FIG. 4 but with a rectangular through passageway for receiving a ratchet wrench, a pipe wrench or adjustable end wrench.
Figure 13:
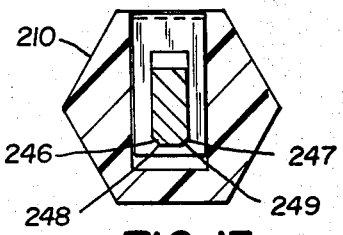
FIG. 13 represents a view of the handle of FIG. 12, this view taken on the line 13—13 thereof and looking in the direction of the arrows.

EMBODIMENTS OF FIGS. 12 and 13

Referring next to FIG. 12, a handle 210 is similar to that shown in FIG. 4 in that the body is preferably of molded plastic. A through passageway 218 is depicted as rectangular but this is merely a preferred configuration. Since this handle is anticipated to be used as a torque assist the tool handle is made a little larger such as about one and one-half inches hexagonial. A trigger 224 is very similar to that shown in FIG. 4 and includes a front leg portion 226 which is slidable in slot 212. A spring 32 engages and moves the bridge portion 230 of the trigger. A rear leg 228 has an aperture 238 which is engaged by a pin 240 to limit the outward movement of the trigger.

In FIG. 13 is seen the trigger 224 in an engaging condition in which the forward blade portion is urged outwardly by spring 32 so that two engaging corners 246 and 247 of the blade enter notches 248 and 249 of contoured handle portions to be hereinafter more fully described. Opening or elongated aperture 238 is made sufficiently long so that like the embodiment of FIG. 7 the trigger may be moved into a releasing condition and by bias means into engaging condition.

It is to be noted that the trigger in this enlarged handle is shown as flush or slightly recessed so as to prevent accidental release of the handle from its placed position.

EMBODIMENT OF FIG. 14

Figure 14:
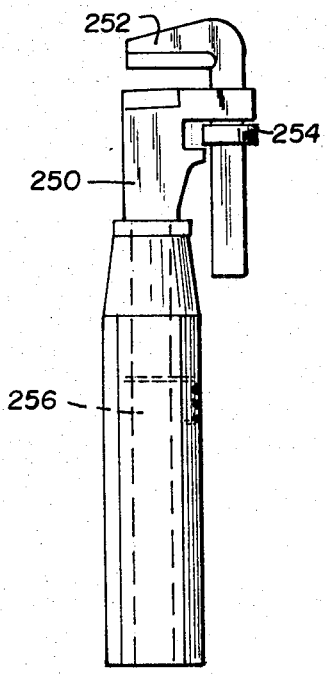
FIG. 14 represents, in a reduced scale and partly diagrammatic, a side view of a pipe wrench having a handle portion configured to have a handle such as in FIG. 12 adjustably mounted thereon.

Depicted in FIG. 14 is a pipe wrench which is shown with a fixed member 250 and a movable jaw 252. Adjustment is provided by a nut 254 which is very conventional. This fixed member 250 is formed with a regular and rectangular shank 256. In this shank portion is formed a series of diagonally formed and positioned slots 248 and 249 (FIG. 13). These notches are longitudinally spaced a desired distance apart to allow the handle 210 to be positioned at the desired location.

EMBODIMENT OF FIG. 15

Figure 15:
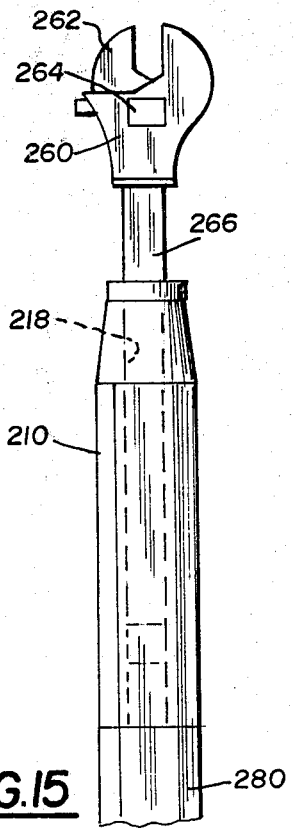
FIG. 15 represents in the reduced scale of FIG. 14 and also partly diagrammatic, a side view of an adjustable end wrench in which the handle portion is configured with a regular cross section and notches are provided for receiving and retaining the handle portion, the adjustability of this handle is depicted with the handle partly extended for the application of additional torque force.

The embodiment of FIG. 15 is very like that of FIG. 14 but instead of a pipe wrench there is shown an end adjustable wrench. A fixed jaw 260 carries a movable jaw 262 moved and retained by a nut 264. A shank 266 provides a regular cross section slidable in the passageway 218 in the handle and having diagonally formed and positioned slots 248 and 249 (FIG. 13) as above noted. As shown, the handle 210 is moved outwardly (downwardly) along the contoured handle or shank 266 to increase the effective length of the shank in the manipulation of the wrench. If and when more leverage or torque is to be applied, an extension or extensions as in FIG. 17 may be inserted in the rear of the passageway 218 as to be hereinafter more fully described.

EMBODIMENT OF FIG. 16

Figure 16:
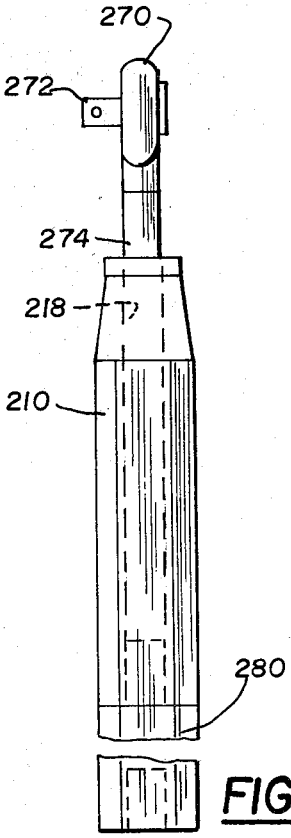
FIG. 16 represents in the reduced scale of FIGS. 14 and 15 also partly diagrammatic and partly in section for illustrative purposes, a side view of a ratchet wrench with the handle portion partly extended and with an extension as seen in FIG. 17 secured at the rear passageway of the handle, this wrench handle portion configured to provide a regular cross section.

The embodiment of FIG. 16 utilizes the handle of FIGS. 12 and 13 to receive and retain a ratchet wrench handle. A ratchet wrench identified as 270 has a post portion 272 and an extending shank portion 274 which is contoured in and with a regular cross section sized to slidably enter and be retained in the passageway 218. As with the embodiments of FIGS. 14 and 15, the handle portion is provided with diagonally formed and positioned slots 248 and 249 (FIG. 13) above noted.

Figure 17:
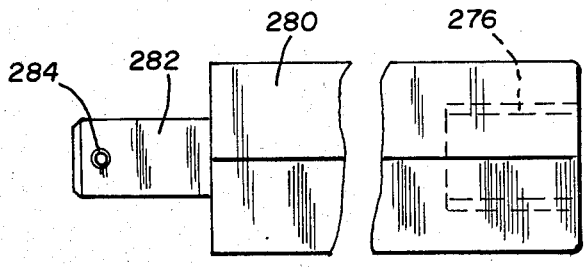
FIG. 17 represents a side view in the scale of FIG. 12, this view diagrammatically showing an extension for use with the handle of FIG. 12 and providing therewith extension means whereby the applied lever arm is increased in length for applied torque to a wrench as depicted in FIGS. 14, 15 and 16.

As shown, this FIG. 16 is partly diagrammatic so as to illustrate the use of the extension of FIG. 17. When the ratchet wrench is used and additional torque or a lever arm is desired the handle 210 is moved sufficiently along the shank 274 so that the rear of the passageway is open and one or more extensions as in FIG. 17 may be used therewith.

EMBODIMENT OF FIG. 17

Referring next and finally to a handle extension as depicted in FIG. 17, it is to be noted that on accassions it is desirable to provide additional torque means. When an extension is desired, the handle 210 is positioned so that a rear portion of the passageway 218 is open. In a metal insert 276 in the rear of the handle an extension 280 is mounted. A protruding member 282 of metal and having a retaining ball detent 284 is mounted in the insert end 276. More than one extension may be used when and where desired by assembling in sequence.

The wrenches illustrated are those most common for the home owner and the do-it-yourself mechanic. In the many household repairs, mechanical repairs and in professional applications the desirability of a tool with a short handle for initial placement often requires additional torque for loosening or tightening. The extension shown in FIG. 17 may be placed in the handle after positioning. The extension is shown with a rectangular passageway but other shapes such as square or hexagonal may be utilized. Other wrench means such as flat jaw wrenches may be provided and this showing is not to reinvent the adjustable wrench but the forming of a shank to which a handle may be adjustably positioned.

It is contemplated that a handle such as shown in FIGS. 12 and 13 will also be in a kit or assembly having a pipe wrench an adjustable open end wrench and a ratchet wrench. Extension sections as in FIG. 17 will also be provided in this kit of tools so that ease and versatility of use is provided. The use of a piece of pipe on a pipe wrench, open end wrench or ratchet wrench is well known but the tendency of this loose fitting pipe to slip is well known, The use of a loose length of pipe is often self-defeating when an overhead manipulation is desired. The extension or extensions of FIG. 17 as shown permit a wrench to be positioned for use and then the extensions added which is a great assist when in a tight or confined place. These removable extensions also allow a mechanic to carry this wrench in a tool box which is impossible otherwise due to its long length.

The tool shanks as depicted in FIG. 2 are of square configuration but may be other shapes as long as one flat driving surface is provided on the tool shank and a like surface is provided in the passageway of the handle 10 and is adapted to transmit torque. Oval shapes are also contemplated but the simplest is square, triangular or hex shaped. The bumpers shown in FIG. 3 are anticipated to provide a closing of the handle passageway for hammering or other pounding on the rear end on the handle and to protect said tool from damage. The extending tool shank may be protected by the overplug 80 which may be used to protect the user against flying chips which may occur when pounding on the end of the tool. The enlarged end may be pounded with said tool shank end protected against mushrooming. This protective bumper or overplug is usually molded of plastic or fiber having both electrical insulating capability and pounding resistance and is easily replaceable.

It is also contemplated that spring 32 may be a leaf spring or may be a plug of rubber or rubber-like material having resilient properties. The pin 40 is anticipated to be moved into position to restrain the trigger and then the pin is rotated so that the short leg 42 of said pin is in the recess 42. Removal of the pin is achieved by turning the short leg to an outward position whereby the pin end may be grasped by needle nosed pliers or may be moved by a blade and hammer. The recess 42 as seen in FIG. 8 may be molded or otherwise formed and the hole for the long leg of the pin 40 is made by drilling. This retaining of a pin by drilling is also used in the embodiments of FIGS. 5 and 6. The small pin is of tempered steel and may be slightly bowed for a tight retention in the drilled hole. Pins may be made of other materials.

It is anticipated that the trigger be made from flat stock of steel, usually heat treated. Strip stock is usually provided and with the trigger cut to length apertures are punched and then the trigger bent to shape. Both the forward leaf and rear leaf are spaced and adapted to slide in the formed transverse slots. The middle of the trigger is urged outwardly with and by the spring so the forward leg is moved into retention of the tool shank when the lower portion 37 of the leg engages the diagonally formed and positioned slots to retain the shank.

The several tool shanks and ends shown in FIG. 2 are representative of the many tools that may be used with the tool handle of FIG. 1. The diagonally formed and positioned slots formed in the tool shank are sized to be entered by a leg portion of the trigger. The diagonally formed and positioned slots are shown as substantially transverse saw slots but diagional notches are also formed and shown. The diagonally formed and positioned slots and trigger member should mate so as to provide a full and positive stop and with the diagonally formed and positioned slots having sufficient clearance so that ease of manipulation of the trigger may occur. The trigger is conventionally made of metal but this is not to preclude making of a plastic with high impact and wear resistance.

Additional leverage is supplied by auxiliary means such as a ratchet wrench handle. This handle is shown with a square drive and also a rectangular passageway. It is also to be noted that the handle is made with a hex shape and to this outer surface a box wrench with the desired engaging means may be used to provide a desired drive assist. The handle may be of plastic, metal or other material as desired.

Although the tool handle is shown in two embodiments and with square and rectangular passageways, these passageways can and may be made without inserts for the torque strength of the handle is dependent upon the composition and size. The use of tool shanks with saw slots does not preclude the use of a trigger means adapted to engage notches at the corners. Vise versa, the wrenches shown in FIGS. 14, 15 and 16 may have saw type slots and only one tool handle be utilized.

Terms such as "leaf", "right", "up", "down", "bottom", "top", "front", "back", "in", "out" and the like are applicable to the embodiments shown and described in conjunction with the drawings. These terms are merely for the purposes of description and do not necessarily apply to the position in which the tool handles and tool shanks may be constructed or used.

While particular embodiments of a tool handle and trigger limit control means have been shown and described it is to be understood the invention is not limited thereto and protection is sought to the broadest extent the prior art allows.

What is claimed is:

1. A tool handle having a through passageway adapted for securing a selected and inserted shank portion of a tool, said tool handle sized for grasping and manipulating by a user and when grasped having a trigger mechanism incorporated in and extending from said handle and as and when actuated to allow insertion, adjustment and/or withdrawal of said shank portion of a tool in said passageway, said shank portion of the tool characterized as having a substantially uniform cross section in that portion that is insertable and carried by the through passageway in the tool handle, a plurality of substantially alike grooves formed in said tool shank portion of a tool slidable and removably mountable in the passageway in the tool handle, these grooves substantially alike and selectively spaced at substantially right angles to the longitudinal axis of the tool, said tool handle and trigger mechanism including:

(a) a tool handle body member having a through passageway which is generally parallel with or is in coincidence with the longitudinal axis of said body member, said passageway having a generally uniform cross section therethrough and with at least one flat surface therein said passageway disposed to slidably receive and retain a shank portion of a tool so as to provide a contiguous relationship of these surfaces so that in mounted condition the shank portion of a tool is positively turned and moved with and by manipulation of the tool handle body member;

(b) a trigger carried in and by said tool handle, this trigger having a generally U-shape including two extending leg portions and with a first forward leg portion longer than the other, said first longer leg portion having an aperture formed therethrough, said aperture shaped and sized to slidably pass a shank portion of a tool insertable and movable in said passageway, this first longer leg portion of the trigger disposed to be slidable and guided in a slot formed in the tool handle body member, said slot and first leg portion extending transversely of and through said passageway, this trigger also having a second leg portion spaced from said first leg portion, this second leg portion a shorter leg portion substantially parallel to the first longer leg portion and slidable and guidable in a second slot formed in the tool handle body member;

(c) bias means carried by and in the tool handle body member and providing an outwardly directed bias;

(d) a bridge portion disposed and extending between said extending first and second leg portions, this bridge portion adapted to receive and retain said bias means so as to move said trigger outwardly, and (e) restraining means fixedly carried by the tool handle and disposed to engage said second trigger leg portion while permitting inward movement of the first and second leg portions of the trigger in said guide and retaining slots to bring said aperture in the first leg portion of the trigger in way of the through passageway in the tool handle so that an insertable portion of a portion of a tool shank may be moved in and out of the passageway and with said restraining means including a small metal pin mounted in a hole formed in the tool handle body and with said metal pin engaging compatible means formed in said second leg portion, this restraining means adapted to inhibit and limit the outward movement of the trigger while retaining the trigger in and on the tool handle body member and to prevent loss of said trigger and bring the lower portion of the first leg and the form aperture therethrough in way of and into a groove to lock the shank portion of a tool in the desired position in the passageway of the tool handle body member.

2. A tool handle as in claim 1 in which said second leg portion is also provided with an elongated aperture through which said small metal pin is passed to provide the retaining means and to control the outward exten of movement of the trigger.

3. A tool handle as in claim 2 in which the metal pin is a straight pin mountable in a drilled hole formed in the tool handle body member.

4. A tool handle as in claim 2 in which the metal pin is L-shaped with the longer leg portion of said L-shaped pin mountable in a drilled hole in the tool handle body member and the short leg of the L-shaped pin is adapted for moving into and retention is provided in a substantially right angle recess formed in the outer surface of the tool handle body member.

5. A tool handle as in claim 1 in which said bias means to move the trigger outwardly is a compression spring carried in a recess formed in the tool handle body member intermediate the first and second legs of the trigger.

6. A tool handle as in claim 1 in which said bias means to move the trigger outwardly is a resilient rubber-like plug carried in a recess formed in the tool handle and intermediate the first and second legs of the trigger.

7. A tool handle as in claim 1 in which the second rear leg portion is formed with a turned end which is substantially normal to the plane of said second leg and the metal pin is transversely carried in said formed hole in the tool handle, said hole and the pin mounted therein adapted to be adjacent to said second leg portion as it is moved and with the mounted pin engaging turned end portion thereof to provide therewith an outer limiting stop.

* * * * *